US007103996B2

(12) United States Patent
Hapke

(10) Patent No.: US 7,103,996 B2
(45) Date of Patent: Sep. 12, 2006

(54) AGITATOR FOR REMOVING WRINKLES FROM CLOTHING

(75) Inventor: Kenyon A. Hapke, Libertyville, IL (US)

(73) Assignee: Ark-Les Corporation, Stoughton, MA (US)

( * ) Notice: Subject to any disclaimer, the term of this patent is extended or adjusted under 35 U.S.C. 154(b) by 547 days.

(21) Appl. No.: 10/436,649

(22) Filed: May 13, 2003

(65) Prior Publication Data

US 2003/0223309 A1 Dec. 4, 2003

Related U.S. Application Data

(60) Provisional application No. 60/380,989, filed on May 15, 2002.

(51) Int. Cl.
*D06F 58/12* (2006.01)

(52) U.S. Cl. ..... 38/14; 38/1 A

(58) Field of Classification Search ..... 38/1 R, 38/3, 7, 14, 1 A, 64, 1 C, 1 D, 69; 34/210, 34/216, 217, 225; 68/5 B, 5 C, 5 R, 6, 222; D32/60; 414/744.1, 744.2, 744.4
See application file for complete search history.

(56) References Cited

U.S. PATENT DOCUMENTS

| | | | | |
|---|---|---|---|---|
| 3,166,923 | A * | 1/1965 | Zacks | 68/5 C |
| 3,696,523 | A * | 10/1972 | Beeley et al. | 34/216 |
| 3,739,496 | A * | 6/1973 | Buckley et al. | 34/210 |
| 3,861,179 | A * | 1/1975 | Orchard | 68/6 |
| 5,094,020 | A * | 3/1992 | Wingfield et al. | 38/1 A |
| 6,925,737 | B1 * | 8/2005 | Bolduan et al. | 38/1 A |

* cited by examiner

*Primary Examiner*—Ismael Izaguirre
(74) *Attorney, Agent, or Firm*—Boyle Fredrickson Newholm Stein & Gratz S.C.

(57) ABSTRACT

An agitator mechanism for a clothes finishing cabinet provides a pendulum mounted hanger bar that may reciprocate under the application of a periodic force by an actuator without rigid connection between the cabinet housing and the hanger bar. Quiet operation is obtained by mounting an actuator motor directly on the hanger bar to be isolated by sound absorbing hanger support materials.

23 Claims, 2 Drawing Sheets

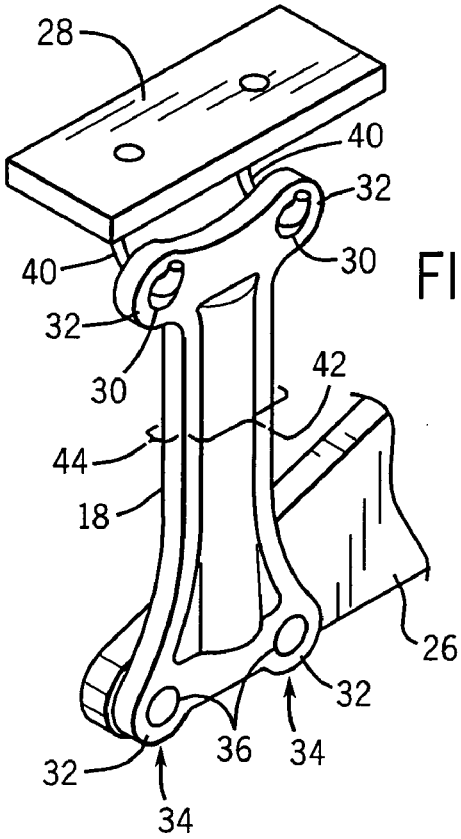
FIG. 3
FIG. 4
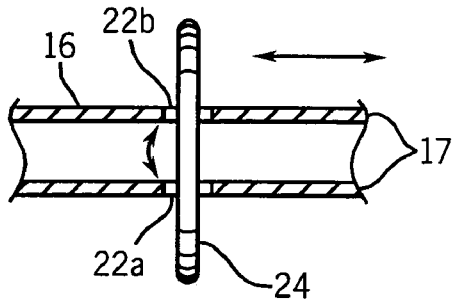
FIG. 5
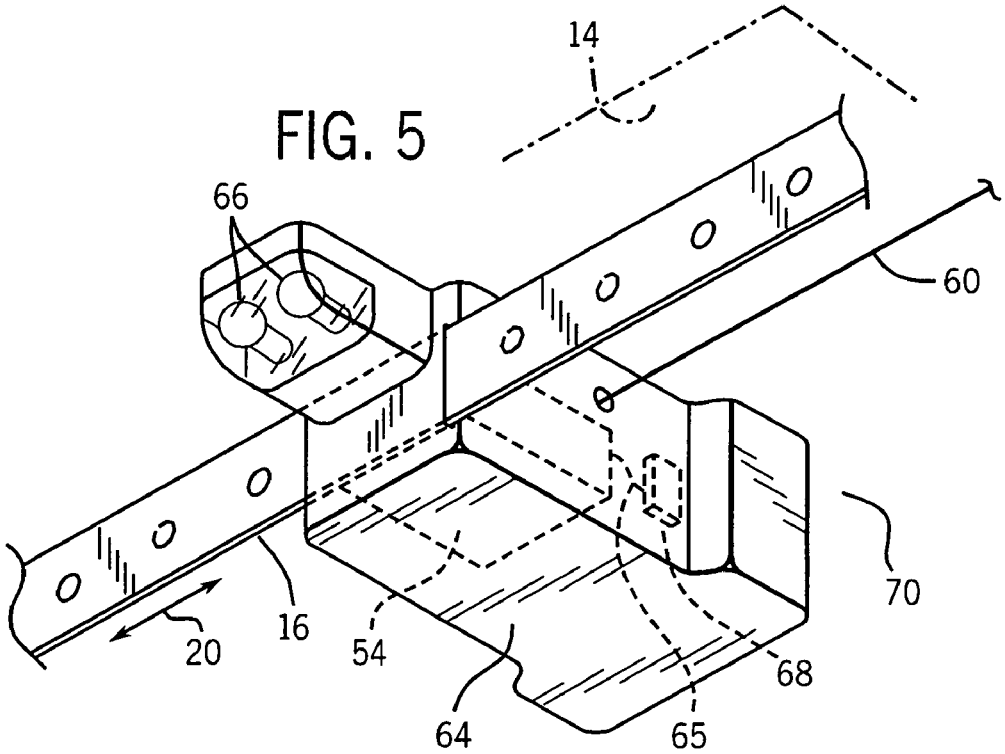

AGITATOR FOR REMOVING WRINKLES FROM CLOTHING

CROSS REFERENCE TO RELATED APPLICATIONS

This application is based on provisional application 60/380,989 filed May 15, 2002 and entitled "Agitator for Removing Wrinkles from Clothing" a claims the benefit thereof.

BACKGROUND OF THE INVENTION

This invention relates generally to machines for removing wrinkles from clothing and in particular to an improved agitator for such devices.

It has been suggested that wrinkles may be removed from clothing by gentle agitation of drying clothes as they hang on hangers. For example, U.S. Pat. No. 3,739,496 describes a finisher in which clothes are suspended on hangers held by a bar within the cabinet. The bar shaken from side to side while moistened or drying air is blown around the clothes. The combined action of the air flow and agitation of the garments removes the wrinkles with relatively little hand labor.

The agitation of the clothes may be performed by means of a motor driven crank connected by a crank arm to the bar holding the hangers. A similar crank mechanism for driving a hanger bar is described in U.S. Pat. No. 3,861,179.

Complete removal of wrinkles from clothing using this technique may require an hour or more to complete. It is therefore desirable that the agitation mechanism be quiet, energy efficient and long-lived. It is further desirable that the force of agitation be limited in the event of an obstruction of the reciprocating mechanism. It is also desirable that the agitation be smooth, reducing unnecessary shifting of and wear to the garments.

While the crank and crank arm of the prior art is relatively simple, it is not ideal in these other respects.

BRIEF SUMMARY OF THE INVENTION

The present invention provides an agitator that makes use of a natural resonance of the hanger bar to moderate agitating motion. The hanger bar is loosely supported to move freely in at least one dimension at the resonant frequency. In this way, the mass of the hanger bar and the clothes transform periodic force by an actuator into smooth sinusoidal motion. Force is applied to the hanger bar by a compliant elastic cord or other mechanism that may accommodate the hanger bar's natural resonant motion.

By eliminating the rigid crank drive mechanism of the prior art, noise transmission is decreased and the force of agitation is limited improving safety and decreasing clothes wear. A smaller motor may be used and energy saved because stalling of the motor under high loads is of less concern. The wear and friction associated with a crank arm linkage is eliminated.

Specifically, the present invention provides an agitator mechanism for use in a garment finisher of a type having a cabinet in which clothes supported on clothes hangers are shaken to remove wrinkles from the clothes. The agitator mechanism includes a hanger bar for holding at least one clothes hanger pendant therefrom and center biasing supports attached between the hanger arm and the cabinet to bias the hanger bar toward a center position so that when displaced from the center position and released, the hanger bar reciprocates at a natural frequency about that center position. An actuator provides a periodic force on the hanger bar near the natural frequency to cause reciprocation of the hanger bar.

Thus, it is one object of the invention to provide an extremely simple mechanism for producing smooth, near sinusoidal motion, decreasing noise harmonics and providing a gentle agitation of clothing.

The center biasing supports holding the hanger bar may be pendulum arms having lower ends attached to the hanger bar and upper ends attached to the cabinet allowing the hanger bar to swing therefrom at a natural frequency equal to the pendulum frequency.

Thus, it is another object of the invention to provide a reciprocation that is to a first order independent of the amount of weight of clothing hung on the hanger bar. Following the normal rules of a pendulum, the frequency of the reciprocation will be determined by the pendulum arm length not the mass of the clothes.

The pendulum arms may be an elastomeric material and may be mounted so as to flex slightly with reciprocation of the hanger bar.

It is another object of the invention therefore to dissipate some energy from the pendulum at high amplitudes to control the amplitude of the motion.

The hanger bar may include at least one outrigger extending perpendicular to a direction of reciprocation of the hanger bar and at least one of the pendulum arms may attach to an outrigger so that the pendulum arm provides at least three points of attachment to the hanger arm defining a plane.

Thus, it is another object of the invention to provide a simple mechanism for stably supporting the hanger bar to move predominately in one reciprocation direction.

The actuator may be a motor mounted on the hanger bar receiving power through flexible leads. The pendulum arms may be sound dampening.

It is thus another object of the invention to reduce sound transmitted to the cabinet and hence to outside the cabinet by placing the motor on the hanger bar isolated by the sound dampening of the pendulum arms.

The motor may be substantially centered on the hanger bar and the motor may fit within a cover attached to the cabinet having an aperture for passing the hanger bar through the cover.

It is thus another object of the invention for the balanced application of force to the hanger bar without direct access to the motor.

The actuator may be a motor positioned on either the hanger bar or the cabinet with an elastic linkage extending between the motor and the other of the hanger bar and the cabinet.

Thus, it is another object of the invention to provide a mechanism that naturally limits force and the conduction of sound between the cabinet and the hanger bar.

The force provided by the hanger bar may be a predetermined amount allowing the hanger bar to be stopped by hand without the stopping of the actuator.

It is another object of the invention to provide a mechanism that limits damage or motor over heating caused by jamming or obstruction of the hanger bar.

The foregoing objects and advantages may not apply to all embodiments of the inventions and are not intended to define the scope of the invention, for which purpose claims are provided. In the following description, reference is made to the accompanying drawings, which form a part hereof, and in which there is shown by way of illustration, a preferred embodiment of the invention. Such embodiment also does not define the scope of the invention and reference must be made therefore to the claims for this purpose.

BRIEF DESCRIPTION OF THE DRAWINGS

FIG. 3 is a fragmentary perspective view of the pendulum arms of FIG. 1 such as may be constructed from a sound absorbing or elastomeric material to provide sound absorption and/or over travel damping of the pendulum motion;

FIG. 4 is a cross-sectional view along lines 4—4 of FIG. 1 showing engagement of the hanger with dual holes in the hanger bar to prevent rotation of the hangers about a vertical axis;

FIG. 5 is a fragmentary perspective view of a cover fitting over the motor of FIG. 1 and providing illumination of the clothes in the cabinet.

DETAILED DESCRIPTION OF THE PREFERRED EMBODIMENT

Figure 1:
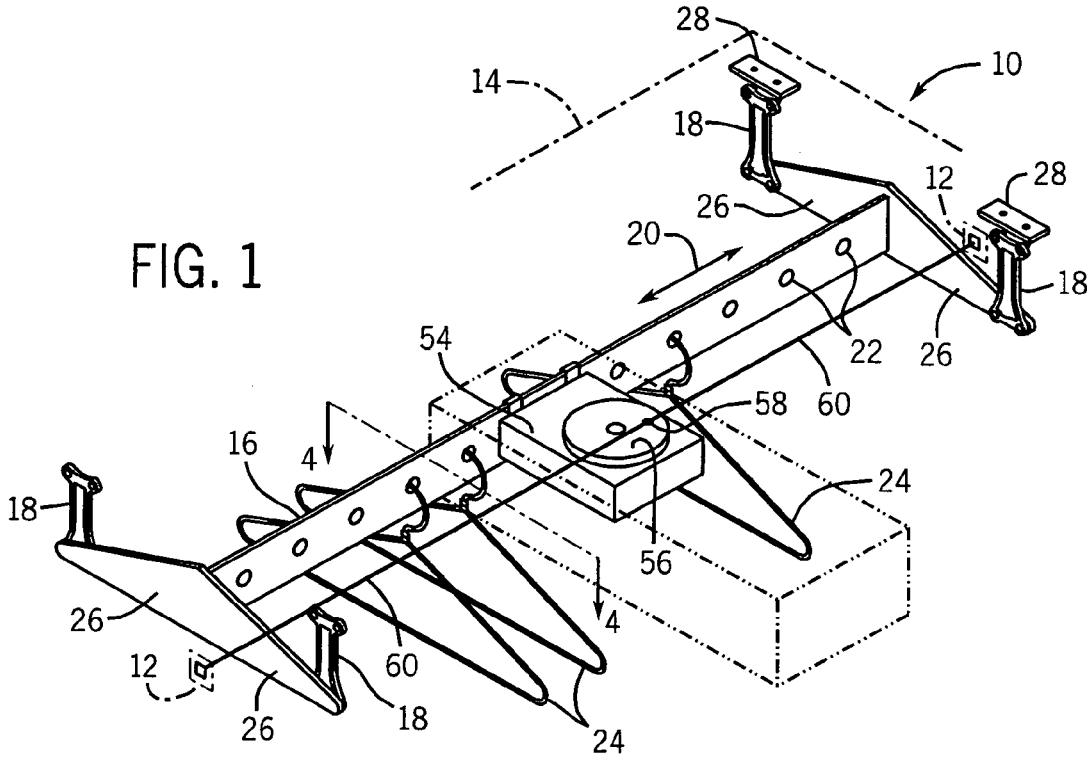
FIG. 1 is a perspective view of the agitation mechanism of the present invention showing a hanger bar suspended by pendulum arms to gently reciprocate pendant hangers, and showing a motor attached directly to the hanger arm and used to provide an exciting force to the hanger arm by means of an elastic strap.

Referring now to FIG. 1, the agitator mechanism 10 of the present invention may be fit within a cabinet (not shown) having sidewalls 12 and a ceiling 14.

The agitator mechanism 10 includes a horizontally disposed hanger bar 16 suspended from beneath the ceiling 14 of the cabinet on pendulum arms 18 to reciprocate in a lateral direction 20. The hanger bar is generally horizontal and includes holes 22 for receiving the hook end of hangers 24 which may hang below the hanger bar 16.

At ends of the hanger bar 16 near sidewalls 12, the hanger bar includes transversely extending outriggers 26. The lower ends of pendulum arms 18 are attached to the transverse extreme ends of the outriggers 26 so that the points of attachment define a plane, preventing twisting of the hanger bar 16 about the lateral direction 20.

Referring now to FIGS. 1 and 3, the upper ends of pendulum arms 18 are attached to hook brackets 28 that in turn are attached the ceiling 14. Pendulum arms 18 may be "dog bone" shaped, having two transversely separated holes 30 in corresponding lobes 32 in the upper end of the pendulum arm 18 and to transversely separated holes 34 in corresponding lobes 32 in the lower end of the pendulum arm 18.

The holes 34 in the lower end of the pendulum arm 18 may be attached to corresponding studs in the outriggers 26 and retained by compression of the elastomeric material around the holes 34 acting on expanded heads on the studs 36 when pushed through the holes 34. In contrast, the holes 30 in the upper end of the pendulum arm 18 are oversized to be received by hooks 40 hanging from a bracket 28.

The body of the pendulum arm 18 in horizontal cross-section has a greater transverse dimension 42 than longitudinal dimension 44 and this, in combination of the transverse orientation of the holes 30 and 34 provide that pendulum arms 18 preferentially allow motion along lateral direction 20 and resist other modes of reciprocation.

Figure 2:
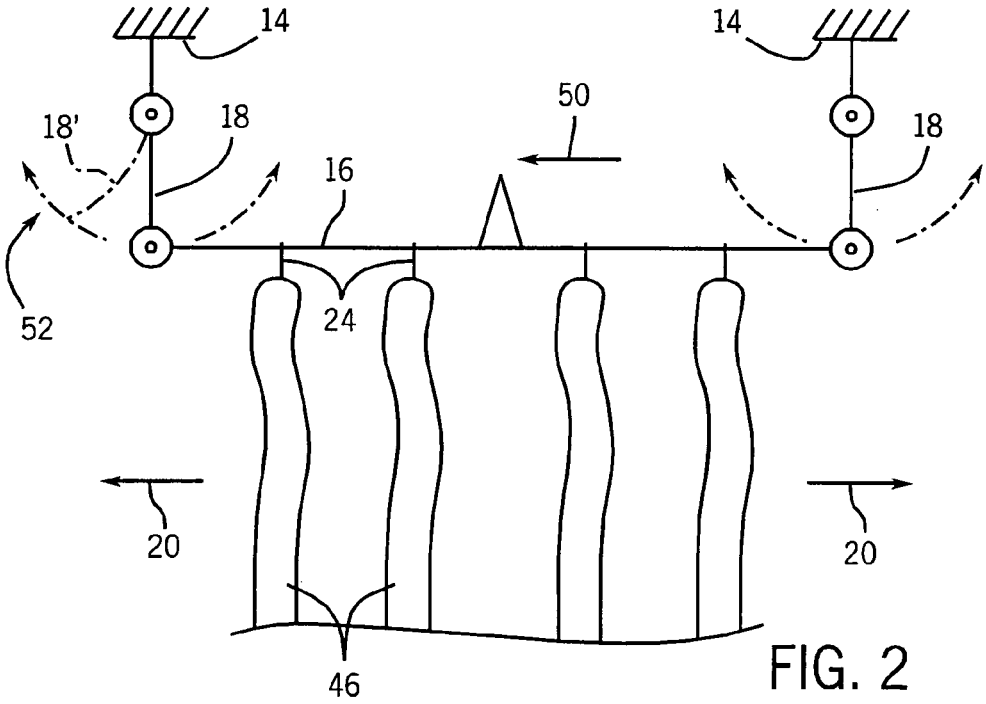
FIG. 2 is schematic diagram in elevation of the mechanism of FIG. 1 showing the pendulum motion of the hanger bar under the application of a periodic exciting force.

Referring now to FIG. 2, it will be understood that the hanger bar 16 and pendulum arms 18 together form a pendulum having a natural period of reciprocation dependent as a first order only on the length of the pendulum arms 18. Accordingly, different weights and amounts of clothing on hangers 24 may be supported from the pendulum arm 18 without substantially upsetting the frequency of the oscillation. The ability of the hangers 24 to swing in the holes 22 further decouples the hangers from the hanger bar 16. More generally, the hanger bar 16 may be mounted in any center-biased arrangement, for example, using springs or the like so that resonant excitation will cause it to reciprocate. Such mass-spring systems, however, do not have the advantage of the pendulum system in being indifferent to the weight of the garments.

Referring still to FIG. 2, each of the pendulum arms 18 provides for pendulum motion of its lower end about its upper end attached to the ceiling 14 of the cabinet. This causes reciprocation in lateral direction 20 of the hangers 24 and the clothes 46 such as draws wrinkles out of the clothes 46 and improves circulation of air and moisture between the clothes 46. Normally the pendulum motion will die out, however, a periodic force 50 applied to the hanger bar 16 may sustain that motion.

At extreme points of travel 52 of the pendulum arms 18, a flexure will occur in the pendulum arm 18' caused by its rigid mounting to the outriggers 26. This flexing takes energy from the hanger bar 16 thus controlling its amplitude of motion and making the amount of force 50 required for continued oscillation less sensitive.

Referring now to FIG. 1, one embodiment the periodic exciting force 50 may be applied to the hanger bar 16 by a motor 54 mounted at the center of the hanger bar 16. The motor 54 may include an eccentric or crank disk 56 attached to rotate around a motor shaft with a crank point 58 eccentric thereto. The crank point 58 may be tied through elastic cord 60 to one or both opposing sidewalls 12. By mounting the motor on the hanger arm, the direct path of sound conduction to the cabinet is thereby eliminated with the elastomeric material of the pendulum arms 18 and the elastic cord 60 serving to damp out the conduction of motor noise to the cabinet.

Equally important, a rigid connection between the hanger bar 16 and the cabinet side walls 12 is eliminated, decoupling motion of the hanger bar 16 from the motion of the motor allowing the resonance of the hanger bar 16 to smooth the reciprocating action. Other mechanisms for applying a force without limiting freedom of motion include, for example, jets of air or pulsating magnetic attraction or the like. The profile over time of the applied force is not critical because the natural resonance of the hanger bar 16 tends to convert it to a sinusoidal motion. Sinusoidal motion reduces harmonic noise and limits the forces applied to the clothes. Nevertheless, in the preferred embodiment, the profile of the force is desirably near sinusoidal and of a frequency near the natural resonant frequency of the hanger bar 16 as loaded with clothing and the motor 54. The pendulum arms 18 may be freely adjusted in length to control the desired frequency of operation of the reciprocation.

Referring now to FIGS. 1 and 5, by mounting the motor 54 in a central location on the hanger bar 16, access on either side of the motor may be had for hangers 24 and the loading of the hanger bar 16 may be evenly distributed reducing any tendency of the hanger bar to reciprocate off the lateral axis 20. A cover 64 may be placed over the motor 54 and attached to the ceiling 14 (or to an upper cover) and to the rear wall 70 of the cabinet to fully enclose the mechanism of the motor 54. The coupling between the motor 54 and the side walls 12 of the cabinet is force limited by the elastic cord 60 and thus the hanger bar 16 protruding from the cover 64 may be stopped by hand and high forces are not generated in the event of jamming of the hanger bar 16 or catching of clothing or the like. Adjustment of the force may be by adjustment of the spring constant (i.e., thickness) of the elastic cord 60 and the eccentricity of the crank disk 56.

The cover 64 may include courtesy lamps 66 for lighting the inside of the cabinet when the cabinet door is open. A cabinet door switch (not shown) controlling the courtesy lamps 66 may serve as an interlock for the motor 54.

Flexible leads 65 may connect the motor 54 to a connector 68 on the rear wall 70 of the cabinet and may be covered by the cover 64.

Referring now to FIG. 4, the hanger bar 16 may include two vertically extending rails 17 so as to provide transversely spaced apart holes 22A and 22B such as engage the hanger 24 to prevent rotation of the hanger 24 about a vertical axis such as might cause rubbing of the clothing or oscillation of the hangers out of the lateral direction 20.

It is specifically intended that the present invention not be limited to the embodiments and illustrations contained herein, but that modified forms of those embodiments including portions of the embodiments and combinations of elements of different embodiments also be included as come within the scope of the following claims.

I claim:

1. An agitator mechanism for use in a garment finisher of a type having a cabinet in which clothes supported on clothes hangers are shaken to remove wrinkles from the clothes, the agitator mechanism comprising:

a hanger bar for holding at least one clothes hanger pendant therefrom;

center biasing supports attached between the hanger bar and the cabinet to biasing the hanger bar toward a center position so that when displaced from that center position and released, the hanger bar reciprocates at a frequency about that center position; and an actuator providing a periodic force on the hanger bar near the frequency to cause reciprocation of the hanger bar.

2. The agitator mechanism of claim 1 wherein the center biasing supports are pendulum arms having first ends attached to the hanger bar and second ends attached to the cabinet allowing the hanger bar to swing therefrom at a frequency equal to a pendulum frequency.

3. The agitator mechanism of claim 2 wherein the pendulum arms are elastomeric material.

4. The agitator mechanism of claim 2 wherein the pendulum arms are mounted to the hanger bar and cabinet so as to flex with reciprocation of the hanger bar.

5. The agitator mechanism of claim 2 wherein the hanger bar includes at least one outrigger extending perpendicular to a direction of reciprocation of the hanger bar and wherein at least one of the pendulum arms attaches to an outrigger so that the pendulum arms provide at least three points of attachment to the hanger arm defining a plane.

6. The agitator mechanism of claim 2 wherein the pendulum arms are configured to preferentially allow the hanger bar to swing only along a single axis.

7. The agitator mechanism of claim 1 wherein the actuator is a motor mounted on the hanger bar to move therewith.

8. The agitator mechanism of claim 7 wherein the motor receives power through flexible leads.

9. The agitator mechanism of claim 7 wherein the motor is substantially centered on the hanger bar.

10. The agitator mechanism of claim 7 wherein the motor fits within a cover attached to the cabinet having apertures for passing the hanger bar through the cover.

11. The agitator mechanism of claim 1 wherein the actuator is a motor held on one structure of either the hanger bar or the cabinet, and including an elastic linkage extending between the motor and the structure not holding the motor.

12. The agitator mechanism of claim 1 wherein the periodic force is limited to a predetermined amount allowing the hanger bar to be stopped by hand without stopping of the actuator.

13. The agitator mechanism of claim 1 wherein the hanger bar provides restraining means for resisting twisting of the hangers about a vertical axis.

14. The agitator mechanism of claim 13 wherein the restraining means are hole pairs spaced apart in a horizontal direction perpendicular to an axis of reciprocation of the hanger bar.

15. The agitator mechanism of claim 1 wherein the pendulum arms include vibration-absorbing material.

16. An agitator mechanism for use in a garment finisher of a type having a cabinet in which clothes supported on clothes hangers are shaken to remove wrinkles from the clothes, the agitator mechanism comprising:

a hanger bar for holding at least one clothes hanger pendant therefrom;

sound dampening hanger bar supports attached between the hanger bar and the cabinet to support the hanger bar; and a motor supported on the hanger bar applying a reciprocating force to the hanger bar.

17. The agitator mechanism of claim 16 wherein sound dampening hanger bar supports are pendulum arms having lower ends attached to the hanger bar and upper ends attached to the cabinet allowing the hanger bar to swing therefrom at a frequency equal to the pendulum frequency.

18. The agitator mechanism of claim 17 wherein the hanger bar includes at least one outrigger extending perpendicular to a direction of reciprocation of the hanger bar and wherein at least one of the pendulum arms attaches to an outrigger so that the pendulum arms provide at least three points of attachment to the hanger arm defining a plane.

19. The agitator mechanism of claim 16 wherein the motor receives power through flexible leads.

20. The agitator mechanism of claim 16 wherein the motor is substantially centered on the hanger bar.

21. The agitator mechanism of claim 16 wherein the motor fits within a cover attached to the cabinet having an aperture for passing the hanger bar through the cover.

22. The agitator mechanism of claim 16 wherein the motor has a crank that connects to the cabinet by an elastic linkage.

23. The agitator mechanism of claim 16 wherein the force applied by the motor is limited to an amount allowing the hanger bar to be stopped by hand.

* * * * *